US006176161B1

(12) United States Patent
Huang et al.

(10) Patent No.: US 6,176,161 B1
(45) Date of Patent: Jan. 23, 2001

(54) DAMAGED SCREW REMOVING SCREWDRIVER

(76) Inventors: Jung-Sheng Huang, F. 1, No.27, Lane 35 Chia-Ho Rd., Ta-Chia Chen; Yi-Ming Tung, No.23, Tsu-Chiang 2nd St, Wuchi Town, both of Taichung Hsien (TW)

( * ) Notice: Under 35 U.S.C. 154(b), the term of this patent shall be extended for 0 days.

(21) Appl. No.: 09/429,438

(22) Filed: Oct. 28, 1999

(51) Int. Cl.[7] ..... B25B 23/10
(52) U.S. Cl. ..... 81/441; 81/177.2
(58) Field of Search ..... 81/436, 441, 451, 81/461, 177.2, 463, 177.5, 177.6

(56) References Cited

U.S. PATENT DOCUMENTS

| | | | | |
|---|---|---|---|---|
| 839,105 | * | 12/1906 | Butler | 81/441 |
| 1,743,505 | * | 1/1930 | Turgeon | 81/463 |
| 2,815,054 | * | 12/1957 | Cummaro | 81/441 |
| 2,923,335 | * | 2/1960 | Joyce | 81/463 |
| 4,187,892 | * | 2/1980 | Simmons | 81/441 |
| 4,325,153 | * | 4/1982 | Finnegan | 81/461 |
| 4,434,687 | * | 3/1984 | Vickio | 81/441 |
| 4,858,504 | * | 8/1989 | Tsai | 81/463 |
| 5,012,709 | * | 5/1991 | Su | 81/463 |
| 5,943,925 | * | 8/1999 | Huang | 81/177.2 |
| 6,033,082 | * | 3/2000 | Lin . | |

* cited by examiner

*Primary Examiner*—David A. Scherbel
*Assistant Examiner*—Joni Danganan
(74) *Attorney, Agent, or Firm*—Rosenberg, Klein & Lee

(57) ABSTRACT

A damaged screw removing screwdriver includes a handle and a shank extending from the handle. The shank has a distal end for being engaged with slots in the head of a bolt. A plurality of blade portions extend radially outward from the distal end of the shank and each blade portion has a cutting edge and a corner. The handle has a plate attached to the distal end thereof so that the blade portions cut into the material of the head of the bolt by impacting the plate on the handle. By the screwdriver, the bolt having rounded slots in the head can still be rotated.

1 Claim, 6 Drawing Sheets

DAMAGED SCREW REMOVING SCREWDRIVER

FIELD OF THE INVENTION

The present invention relates to a screwdriver, and more particularly, to an improved screwdriver for removing a screw that has a damaged head. The damaged screw removing screwdriver has a plurality of blade portions extending radially outward from a periphery of the tip of the screwdriver so that the blade portions cut into the rounded slots in the head of a bolt to rotate the bolt.

BACKGROUND OF THE INVENTION

A conventional screwdriver as shown in FIG. 9 generally includes a shank 100 and a handle (not shown) from which the shank 100 extends. The tip of the shank 100 has a special designed shape such as grooves 101 so as to engage with slots 200 in the head 300 of a bolt so that when the tip is engaged with the slots 200 in the head 300 of a bolt, the bolt can be rotated to be tightened or loosened by rotating the screwdriver. The function is well known in the art. However, the material of the head 300 of the bolt could be softer than the material of the screwdriver so that when rotating the screwdriver, the slots 200 in the head 300 of the bolt could be rounded or damaged. Once the slots 200 in the head 300 of the bolt is rounded, the screwdriver cannot be engaged with the slots 200 properly and the bolt will not be rotated when rotating the screwdriver. Two special designed damaged screw removing screwdrivers known to applicant are respectively illustrated in U.S. Design Pat. No. 371,946, which is issued on Jul. 23, 1996 and U.S. Design Pat. No. 405,672 which is issued on Feb. 16, 1999. Both of the two patented damaged screw removing screwdrivers have a tip portion so as to engage with the bottom of the damaged head of a bolt so as to tighten or loosen the bolt having the damaged head. Nevertheless, a drill is required to drill a notch in the damaged head of a bolt so that the tip portion of the damaged screw removing screwdriver can easily engage with the head of the bolt. In other words, the user has to prepare a drilling tool to drill a notch in the damaged head of the bolt.

The present invention intends to provide a damaged screw removing screwdriver to rotate a bolt wherein the slots in the head of the bolt are rounded or damaged. The screwdriver has a plurality of blade portions which extend radially outward from the tip of the screwdriver so that the blade portions cut into the bottom of the rounded slots in the head of he bolt by pressing the screwdriver toward the head of the bolt.

SUMMARY OF THE INVENTION

In accordance with one aspect of the present invention, there is provided a damaged screw removing screwdriver comprising a handle and a shank extending from the handle. The shank has a distal end and a plurality of blade portions extend radially outward from the distal end of the shank. Each of the blade portions has a cutting edge and a corner. The cutting edge and the corner of each blade portion cut into the material of the rounded slots of the head of a bolt by impacting the handle toward the bolt so that the bolt can be tightened or loosened by rotating the screwdriver.

The primary object of the present invention is to provide a damaged screw removing screwdriver which has blade portions extending from the periphery of the shank and the blade portions are to be cut into the rounded slots of the head of a bolt so that the bolt having a rounded slots in the head is still tightened or loosened conveniently.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
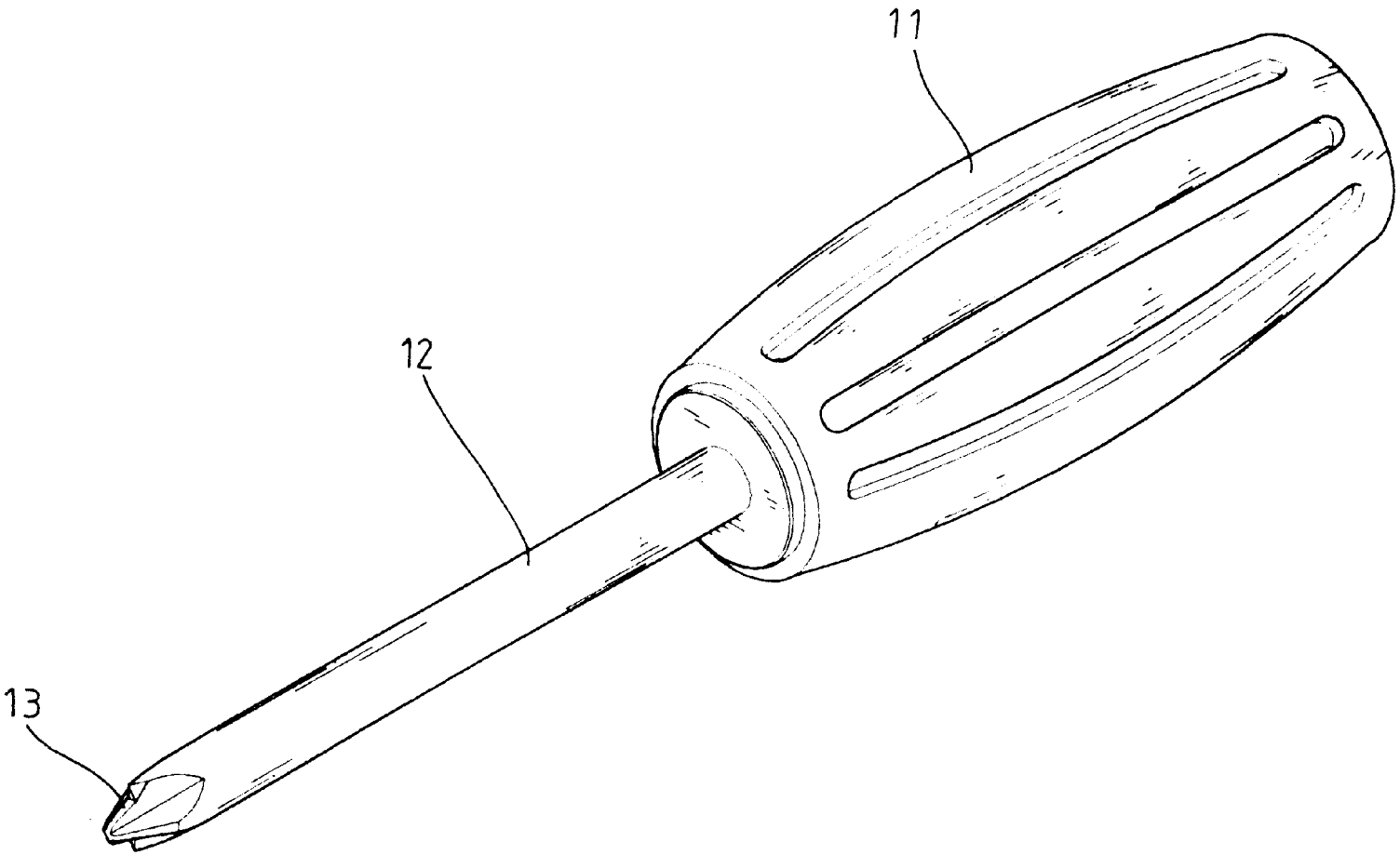
FIG. 1 is a perspective view of the damaged screw removing screwdriver in accordance with the present invention.
Figure 2:
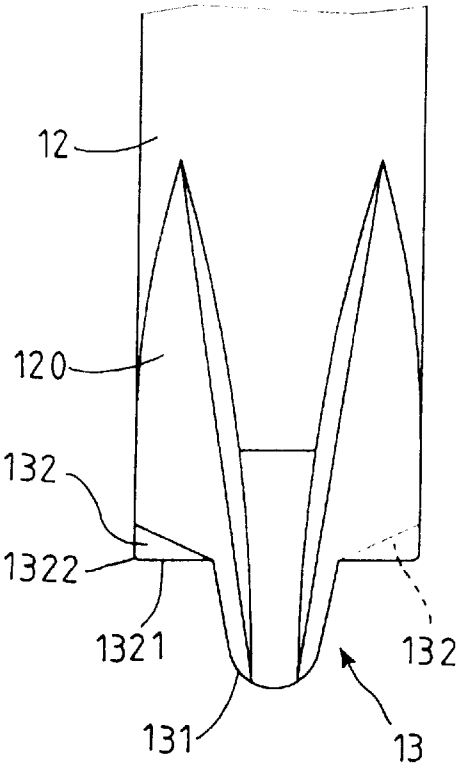
FIG. 2 is an enlarged illustrative view to show the first embodiment of the distal end of the damaged screw removing screwdriver of the present invention.

Referring to FIGS. 1 and 2, the damaged screw removing screwdriver in accordance with the present invention comprises a handle 11 and a shank 12 extending from the handle 11. The shank 12 has a distal end 13 from which a protrusion 131 extends. A plurality of grooves 120 defined radially in a periphery of the shank 12 and a plurality of blade portions 132 extend radially outward from the distal end 13 of the shank 12. The blade portions 132 are respectively located at the lower or distal end of the shank 12 defining the grooves 120. Each of the blade portions 132 has a cutting edge 1321 and a corner 1322. The cutting edges 1321 are defined by grinding a triangular portion from the material of the blade portion 132. The protrusion 131 is located between the blade portions 132.

Figure 4:
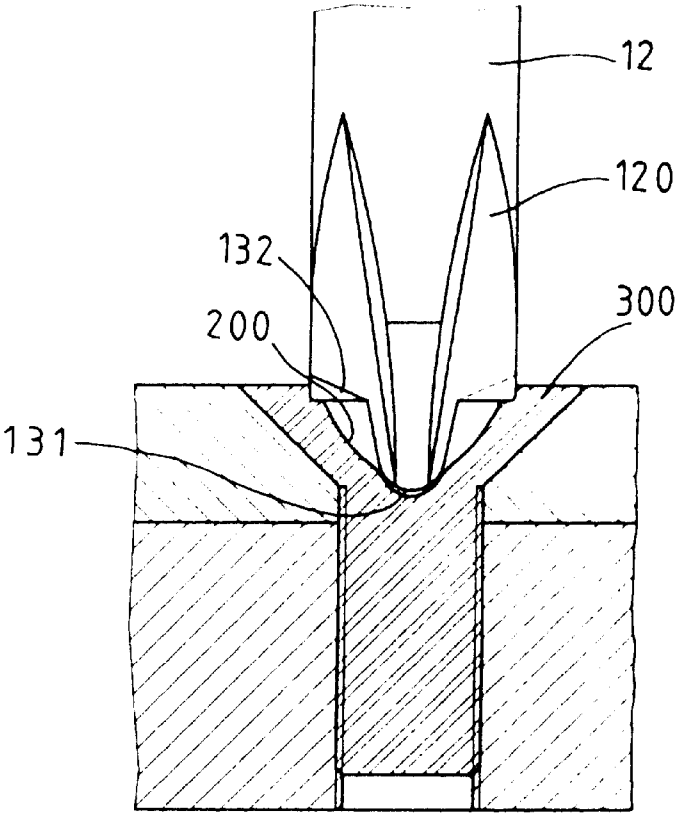
FIG. 4 is a cross-sectional view to show the blade portions of the damaged screw removing screwdriver cut into the periphery defining the rounded slots of the bolt.
Figure 3:
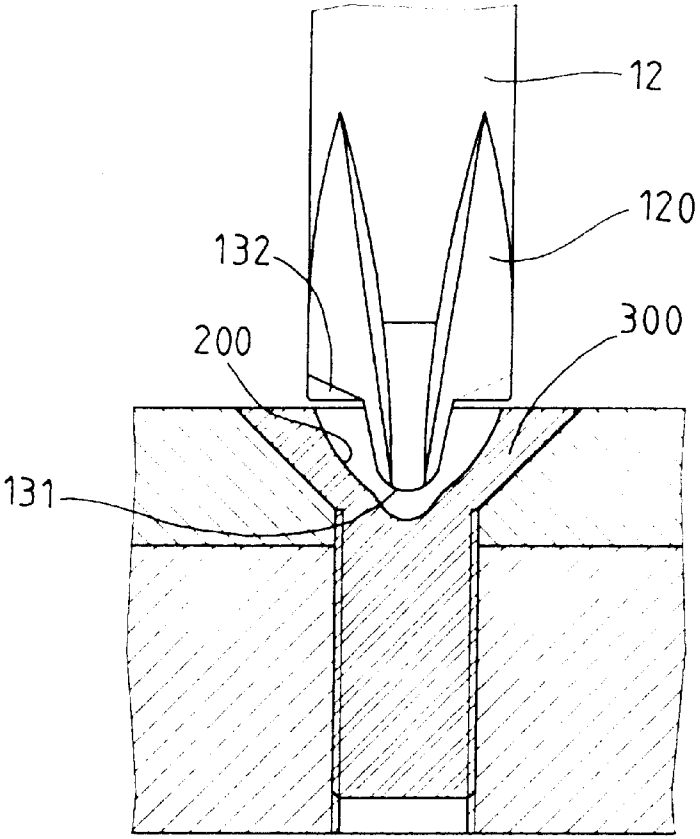
FIG. 3 is a side elevational view, partly in section, of the damaged screw removing screwdriver in accordance with the present invention to be cut into the head of a bolt.

Referring to FIGS. 3 and 4, when the slots 200 of the head 300 of the bolt is rounded so that the regular screwdriver cannot engage with the rounded slots 200, the user may use the damaged screw removing screwdriver of the present invention, wherein the width between two diametrically opposite corners 1322 is larger than the width of the rounded slots 200. The user may use a hammer to hit the handle 11 of the screwdriver to force the blade portions 132 to cut into the periphery defining the slots 200 as shown in FIG. 4 and the protrusion 131 facilitates the positioning of the screwdriver when inserting the distal end 13 of the shank 12 in the head 300 of the bolt. Therefore, the bolt having the rounded head 300 can be easily rotated to be tightened or loosened.

Figure 6:
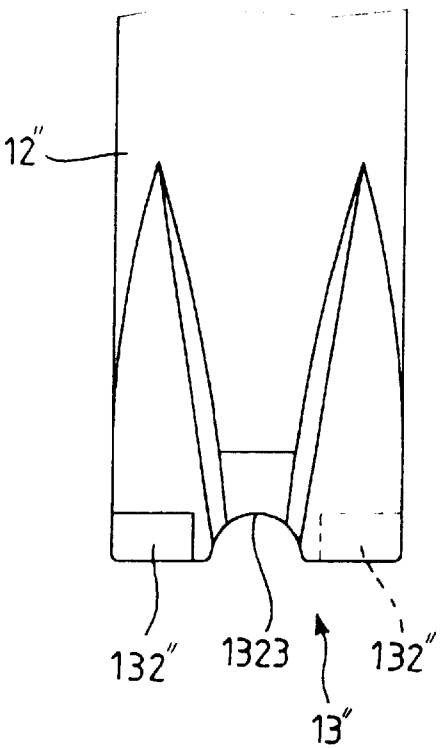
FIG. 6 is an illustrative view to show a third embodiment of the distal end of the damaged screw removing screwdriver of the present invention.
Figure 5:
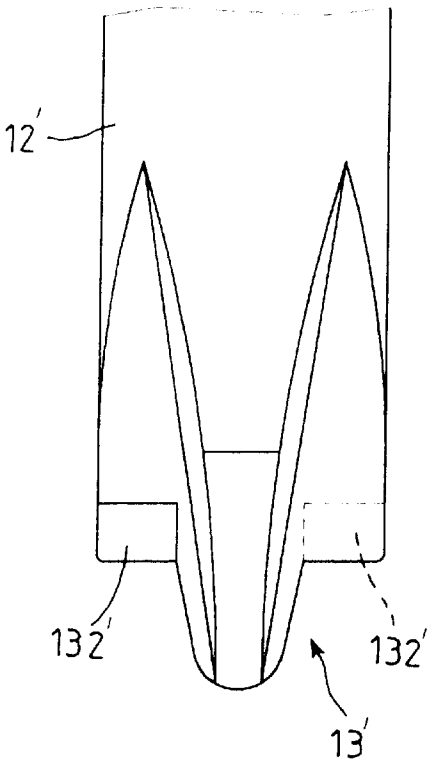
FIG. 5 is an illustrative view to show another type of the blade portions of the damaged screw removing screwdriver of the present invention.

FIG. 5 shows that the blade portions 132' can be made by removing a rectangular portion of the material from the blade portion 132'. FIG. 6 shows that the distal end 13" of the screwdriver can be made to be a straight pattern and a notch 1323 defined therein so as to engage with the slot having the same shape as that of the distal end 13" as shown in FIG. 6. It is to be noted that the notch 1323 is located between the blade portions 132".

Figure 7:
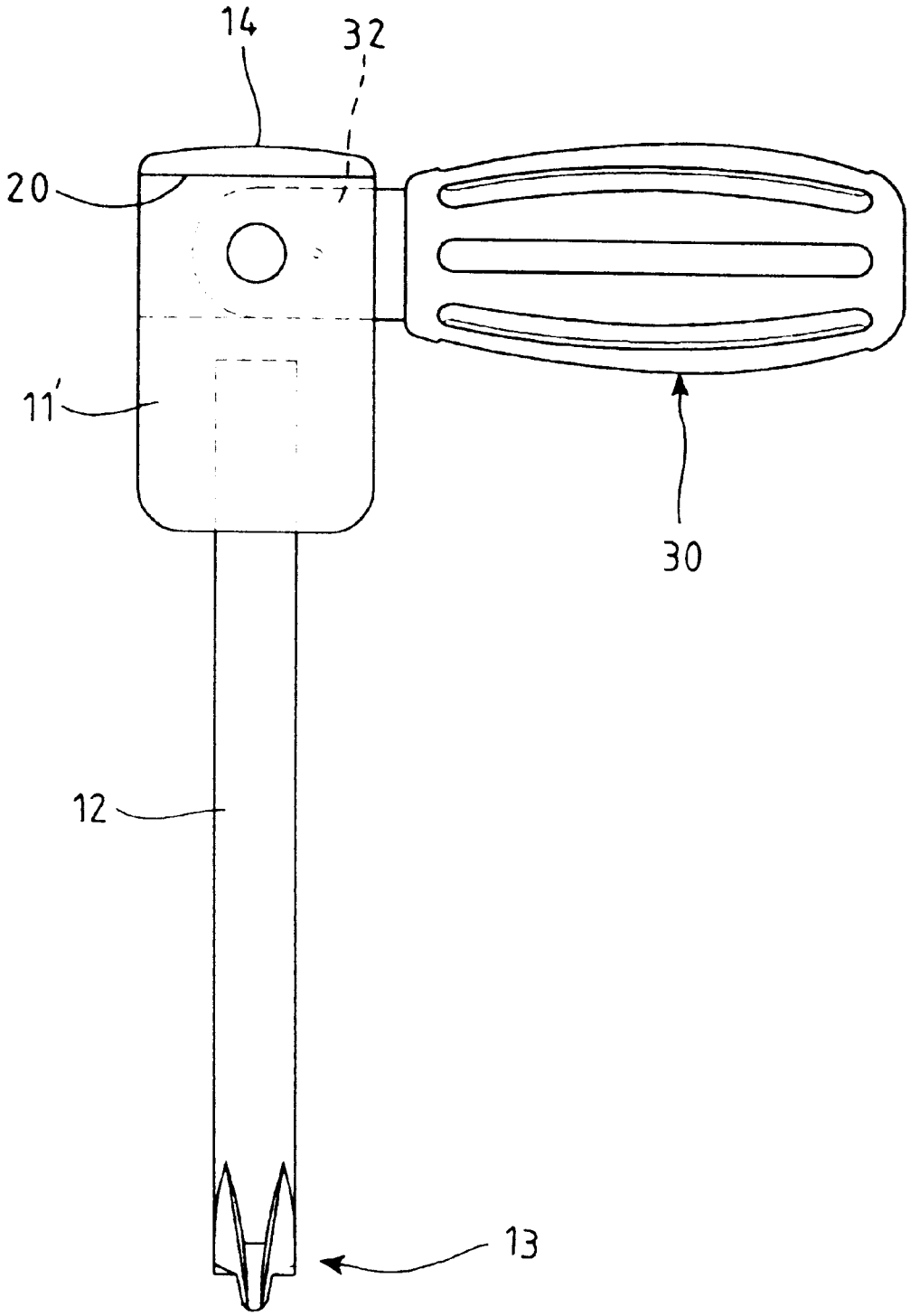
FIG. 7 is a plan view to show a fourth embodiment of the damaged screw removing screwdriver of the present invention.
Figure 8:
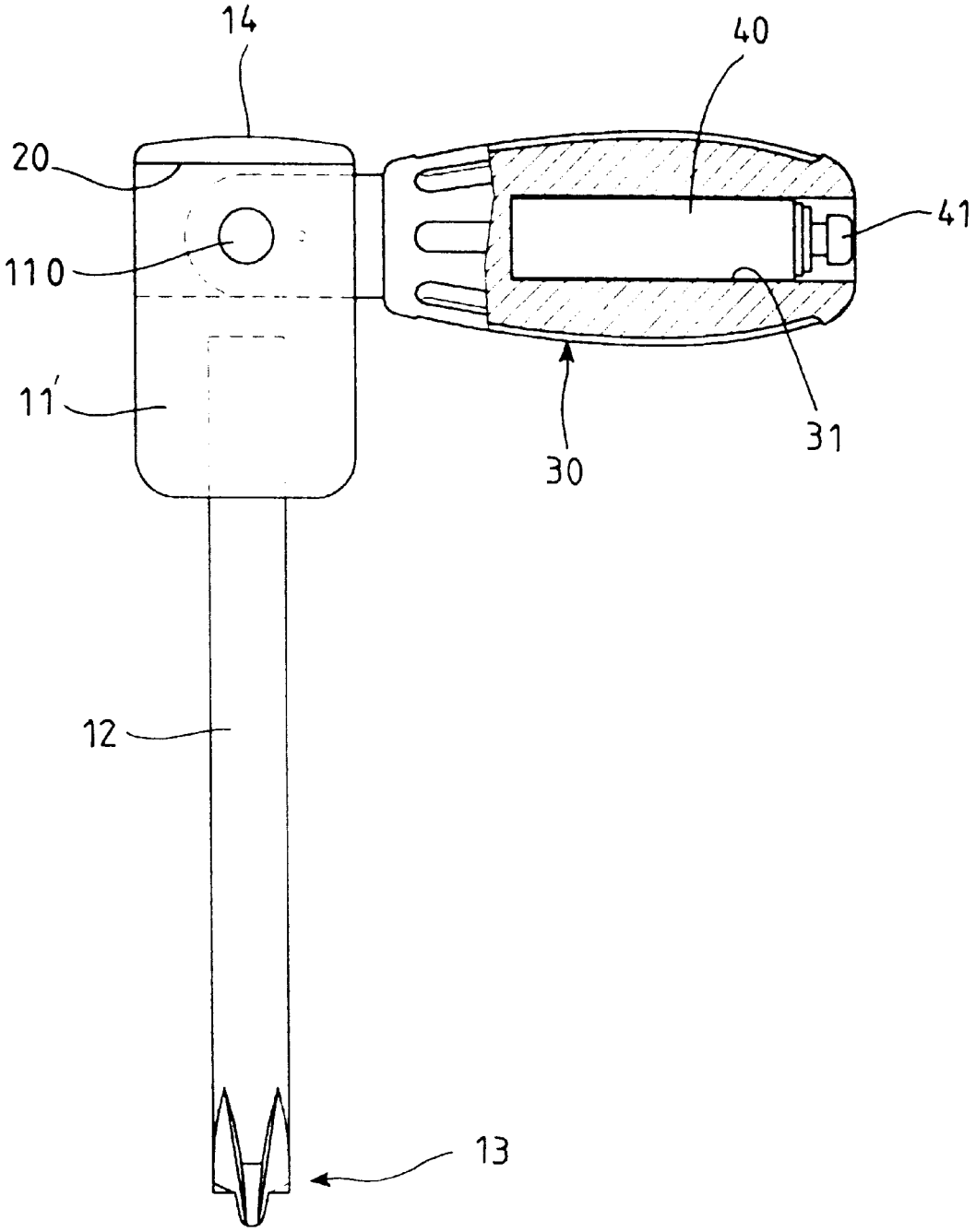
FIG. 8 is a cross-sectional view to show the auxiliary handle of the third embodiment of the damaged screw removing screwdriver of the present invention.
Figure 9:
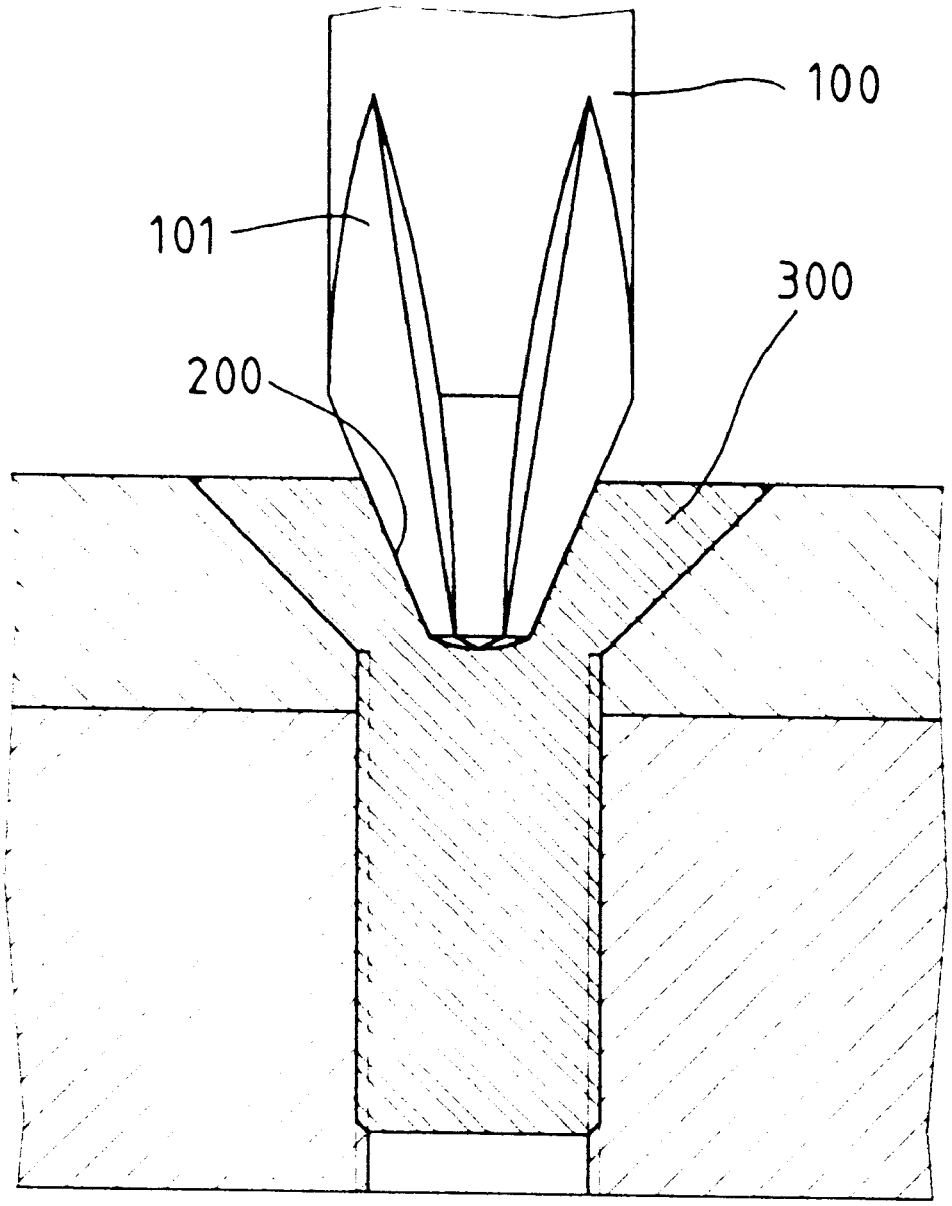
FIG. 9 PRIOR ART
FIG. 9 is a cross-sectional view to show a conventional screwdriver engaged with the head of a bolt.

Referring to FIGS. 7 and 8, the handle 11' has a recess 20 defined radially therein and an auxiliary handle 30 has a lug 32 extending therefrom which is pivotally engaged with the recess 20 by a pin 110. A plate 14 is connected to a distal end of the handle 11' so that the user may hold the auxiliary handle 30 and hit the plate 14 on the handle 11' to conveniently insert the distal end 13 into the rounded slots of the head of a bolt. The auxiliary handle 30 has a chamber 31 defined therein and a retractable rod 40 is received in the chamber 31. A magnet 41 is attached to a distal end of the retractable rod 40 so that when extending the retractable rod 40, small lost parts can be attached on the magnet 41.

According to the above description, the damaged screw removing screwdriver of the present invention is helpful in rotating the bolt having a rounded or damaged slots in the head of the bolt. It is to be noted that the damaged screw removing screwdriver can be made to have Phillips head to remove Phillip, Pozi, Star, Hex, Square and Clutch screws. The damaged screw removing screwdriver can also have Standard head to remove slotted screw heads.

While we have shown and described various embodiments in accordance with the present invention, it should be clear to those skilled in the art that further embodiments may be made without departing from the scope and spirit of the present invention.

What is claimed is:

1. A damaged screw removing screwdriver comprising:

A handle having a radially directed recess formed in a first end thereof;

a shank coupled to a second end of said handle and extending therefrom, said shank having a distal end and a plurality of blade portions extending radially outward from said distal end, each of said blade portions having a cutting edge and an outer corner portion;

an auxiliary handle pivotally coupled to said handle within said recess, said auxiliary handle having a chamber defined therein; and, a retractable rod received in said chamber and having a magnet attached to a distal and of said retractable rod.

* * * * *